United States Patent [19]

Penny et al.

[11] 4,313,332

[45] Feb. 2, 1982

[54] ROTARY FORGING MACHINE

[75] Inventors: William A. Penny, Brockenhurst; Robert A. C. Slater, London, both of England

[73] Assignees: The City University; The Worshipful Company of Pewterers, both of London, England

[21] Appl. No.: 116,542

[22] Filed: Jan. 29, 1980

[30] Foreign Application Priority Data

Feb. 1, 1979 [GB] United Kingdom ..... 03561/79

[51] Int. Cl.[3] ..... B21J 13/02

[52] U.S. Cl. ..... 72/406

[58] Field of Search ..... 72/89, 95, 101, 111, 72/406; 51/123 R, 131.1, 126

[56] References Cited

U.S. PATENT DOCUMENTS

| | | | |
|---|---|---|---|
| 2,505,924 | 5/1950 | Varga | 72/111 |
| 2,524,420 | 10/1950 | Blampin | 72/95 |
| 3,523,442 | 8/1970 | Marciniak | 72/406 |
| 3,533,259 | 10/1970 | Marcovitch | 72/86 X |
| 3,625,041 | 12/1971 | Jeuken | 72/101 |
| 3,703,823 | 11/1972 | Wilson | 72/406 |

*Primary Examiner*—James G. Smith

*Attorney, Agent, or Firm*—Birch, Stewart, Kolasch & Birch

[57] ABSTRACT

A rotary forging or upsetting machine comprising an upper platen and a lower platen, the lower platen being rotatable about a first axis and the upper platen being rotatable about a second axis which intersects the first axis, the upper platen being mounted on carrier which is pivotable about an axis which passes through the point of intersection of the first and second axes, means being provided for adjusting the angle of the upper platen while the platens are rotating, and means being provided for applying a force to the lower platen to move it towards the upper platen so that a workpiece carried by the lower platen is deformed by the upper platen moving around the workpiece.

15 Claims, 11 Drawing Figures

ROTARY FORGING MACHINE

BACKGROUND OF THE INVENTION

This invention relates to a rotary forging or upsetting machine.

Rotary forging or upsetting machines which utilize the plastic deformation of metal are known. In some known machines the workpiece is stationary in terms of rotation about the machine vertical axis and the lower platen with the workpiece is moved in the direction of the applied force relative to the vertical axis of the machine and the upper platen. In other known machines the workpieces are stationary with provision made to move the upper platen assembly in the direction of the machine vertical axis and provision for applying the desired force. This is achieved by the use of a combination of a hydraulically operated cylinder together with hydrostatic bearings to provide rotary drive and 'wobbling'. All are incorporated in the upper platen assembly and the lower platen is maintained stationary.

The known designs lead to complex kinematic arrangements which are inherently costly and liable to failure.

The principle of rotary forging is shown in FIG. 1 and the relationship between angular velocities of the upper and lower platen and a point in the plastically deforming region will now be described generally. A conical upper platen 10 has a semi-angle $(\pi/2)-\alpha$ about an axis $Z_2$ which is at an angle $\alpha$ to the vertical axis $Z_1$. The axes $Z_1$ and $Z_2$ intersect at the point 0. Plastic deformation of the workpiece 11 is caused by the application of force F to the lower platen 12 in the direction of axis $Z_1$.

Consider a point Q in a plastically deforming region which is at radius $r_1$ and rotating about the axis $Z_1$ of the workpiece 11 in the plane OR at an angular velocity $\omega_1$. The instantaneous velocity of the point P in the plastically deforming region, tangential to the circle of radius $r_1$ is given by $$V_1=\omega_1 r_1$$

Let the point P in the plastically deforming region be coincident with a point Q on the surface of the conical platen 10 at a distance $r_2$ from the axis $Z_2$. Let point Q be moving at an instantaneous velocity $V_2$ tangential to the circle radius $r_2$, then $$V_2=\omega_2 r_2$$

where $\omega_2$=angular velocity about $Z_2$.

If at point P no slip takes place between the surface of the workpiece 11 in the plane OR and the surface of the conical platen 10, $$\text{then } V_1=V_2$$

$$\text{or } \omega_1 r_1=\omega_2 r_2$$

$$\text{but } r_2=r_1 \cos\alpha$$

$$\text{therefore } \omega_1 r_1=_2 r_1 \cos\alpha$$

$$(\omega_1/\omega_2)=\cos\alpha$$

Thus, the plastically deforming region may be caused to rotate about the axis of the workpiece with no slip occurring in the plane OR by any combination of angular velocities which satisfy the equation $(\omega_1/\omega_2)=\cos\alpha$.

A known configuration which satisfies the equation is for the lower platen 12 together with the workpiece 11 to be maintained stationary relative to the axis $Z_1$ and the axis $Z_2$ rotated at an angular velocity $\omega_1$ about the axis $Z_1$ whilst the upper conical platen 10 rotates at an angular velocity $\frac{2}{3}2$ about the axis $Z_2$.

This relative motion is known as "wobbling" and has been used in rotary forging machines to date.

Another known configuration which satisfies the equation is for the upper platen to be maintained stationary relative to the axis $Z_2$ and the axis $Z_1$ rotates about the axis $Z_2$ at an angular velocity $\omega_2$ whilst the lower platen together with the workpiece 11 rotates at an angular velocity $\omega_1$ about the axis $Z_1$.

Thus, the workpiece 11 and lower platen 12 is "wobbling" about the fixed upper conical platen.

In each of the arrangements described above it is necessary to provide for force and displacement between the upper conical platen 10 and the workpiece 11 in the direction of axis $Z_1$. This is achieved by maintaining either the upper platen 10 or lower platen 12 stationary in terms of axial displacement relative to axis $Z_1$ and displacing the other member accordingly. The desired relative axial displacement can also be achieved by displacing both the upper platen 10 and the lower platen 12 simultaneously. The force F can be applied by a screw-jack or hydraulic jack.

The most favoured arrangement is the second configuration referred to above with the additional facility to vary the angle $\alpha$.

British Patent Specification No. 1,224,260 shows a machine where angle $\alpha$ can be adjusted but adjustment can only be made when the machine is stationary. It is therefore not possible to adjust $\alpha$ continuously during the forging process.

U.S. Pat. No. 3,523,442 permits $\alpha$ to be adjusted continuously during the forging process but requires a third, almost concentric, bearing.

In the known configuration described above two separate degrees of freedom are required which are almost concentric about either the $Z_1$ or $Z_2$ axes since, for practical considerations $\alpha \leqq 15°$. If a facility is provided to vary $\alpha$ during the process it may be necessary to introduce a third degree of freedom about the $Z_1$ or $Z_2$ axes.

The known arrangements require constraint of forces due to gyroscopic couples. These arise from the axes of rotating masses being displaced in space. It can be seen that due to plastic deformation of the workpiece in the direction OR, forces will exist between the upper platen 10 and the workpiece 11 in that direction. The radial displacement of the axis of the upper platen 10 relative to the axis of the lower platen 12 and workpiece 11, will depend upon the radial force and the sum of the radial compliance of the individual bearing systems. Manufacturing applications can arise where the tools designed to achieve a desired shape or form cause radial deformation of the workpiece. Relative radial displacement of the axes will cause errors in geometry of the workpiece and poor quality of surface finish due to angular velocity relationships which do not comply with the requirements to satisfy the equation $(\omega_1/\omega_2)=\cos\alpha$.

Any sliding which occurs between the upper platen 10 and workpiece 11 will lead to tool wear and the possibility of reduction in surface finish quality of the workpiece. In the known designs of machine the radial compliance of the individual bearing system is accumulative and leads to the upper platen sliding radially relative to the workpiece.

SUMMARY OF THE INVENTION

This invention relates as aforesaid to a rotary forging or upsetting machine.

According to the present invention there is provided a rotary forging or upsetting machine comprising a first platen and a second platen disposed at an angle to each other in a machine frame, means for rotating both platens about independent intersecting axes relative to the machine frame, means for adjusting the angle between the first and second platens whilst said platens are rotating and means for applying a force to at least one platen to move it towards the other platen.

The arrangement is such that the correct velocity relationship $(\omega_1/\omega_2)=\cos\alpha$ can be maintained at the interface between the upper platen and the workpiece.

Preferably means are provided for adjusting the angle between the upper and lower platens whilst said platens are rotating.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail certain illustrative embodiments of the invention, these being indicative however of only some ways in which the principle of the invention may be employed.

In said annexed drawings.

DESCRIPTION OF THE PREFERRED EMBODIMENTS

Figure 1:
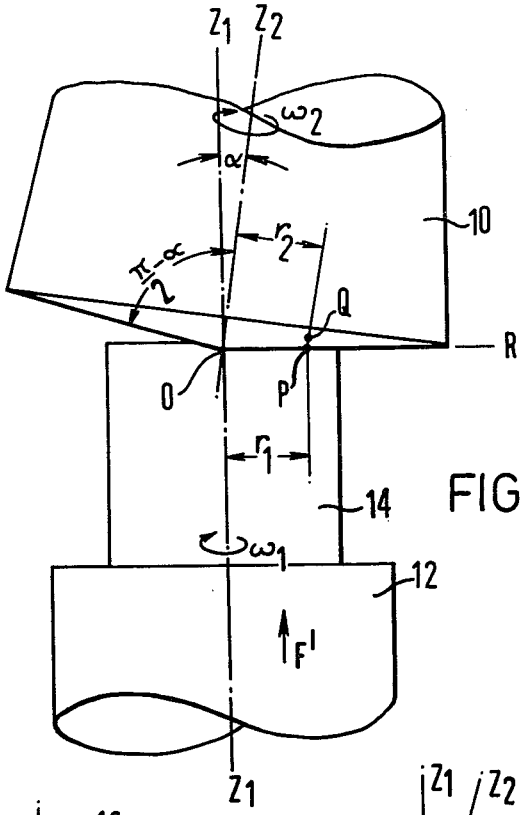
FIG. 1 is a diagram illustrating the principle of rotary forging.

The rotary forging machine has a main frame 10 in which is mounted a housing 11 for a support spindle 12 of a lower platen 13 which is rotatable about an axis $Z_1$. Mounted on the lower platen 13 is a workpiece 14. The housing 11 is movable along the axis $Z_1$ by hydraulic or pneumatic means or by a screw-jack to produce a force F. The workpiece 14 is contacted by an upper conical platen 15 having a support spindle 16 rotatable about an axis $Z_2$ which is at an angle $\alpha$ to the axis $Z_1$ and intersects the axis $Z_1$. The spindle 16 is mounted in a housing 17 which is mounted in trunnion bearings 18 carried by the main frame 10, the axis A—A of the trunnion bearings 18 passes through the axis $Z_1$ at the point of intersection with the axis $Z_2$. The housing 17 is connected to adjusting means 19 carried by the frame 10, the adjusting means 19 enabling the angle $\alpha$ to be adjusted. Thus the angle $\alpha$ can be varied whilst the point of intersection of the axes $Z_1$ and $Z_2$ remains fixed. The adjusting means 19 can be manual, as shown, or can be automatic. The variation in amplitude and frequency of the angle $\alpha$ may be synchronized with the angular rotation of the upper platen 15 and workpiece 14.

Rotation of the lower platen 13 together with the workpiece 14 occurs at an angular velocity $\omega_1$ about axis $Z_1$ and the rotation of the upper conical platen 15 occurs at an angular velocity $\omega_2$ about axis $Z_2$ and thus satisfies the equation $(\omega_1/\omega_2)=\cos\alpha$.

The lower platen 13 can be caused to rotate either by a rotational drive to the lower platen support spindle 12, or by frictional forces between the upper platen 15 and the workpiece 14 from a rotational drive to the upper platen spindle 16.

The upper platen 15 can be caused to rotate about axis $Z_2$ either by a rotational drive to the upper platen spindle 16 or by frictional forces between the workpiece 14 and the upper platen 15.

With such a bearing arrangement the effect of the compliance of the bearing systems is not accumulative as in the known systems.

Figure 6:
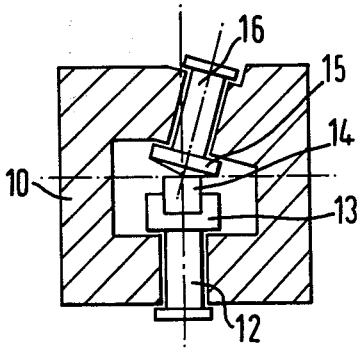
FIG. 6 is a diagram showing the compliance of the bearings.
Figure 7:
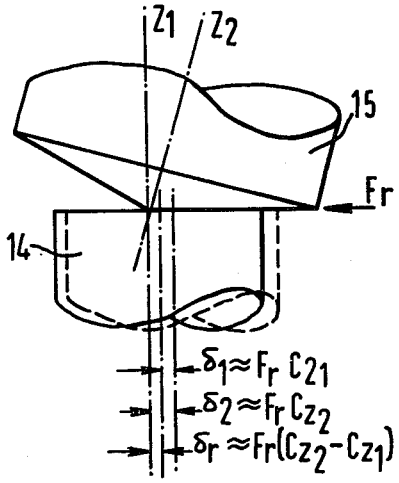
FIG. 7 is a diagram showing the effect of the bearing compliance.

If, as shown in FIGS. 6 and 7, the radial compliance between the upper conical platen spindle 16 and the frame 10 is $C_{Z2}$ and the radial compliance between the lower platen spindle 12 and the frame 10 is $C_{Z1}$, then assuming that the compliance radially of the workpiece 14 relative to the lower platen spindle 12 is zero, then the compliance radially of the upper platen axis $Z_2$ relative to the workpiece axis $Z_1$ is given by $C_{tot}=C_{Z1}-C_{Z2}$.

If $\alpha$ is not large, then the total radial displacement of the axis $Z_1$ relative to axis $Z_2$ at the point 0 due to force Fr is given approximately by $\delta_r \approx Fr(C_{Z1}-C_{Z2})$.

Figure 4:
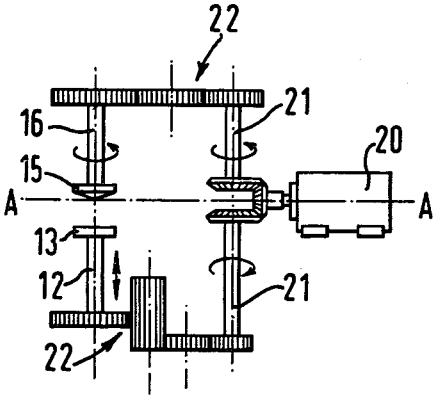
FIG. 4 is a diagram showing one arrangement of driving the platens.
Figure 5:
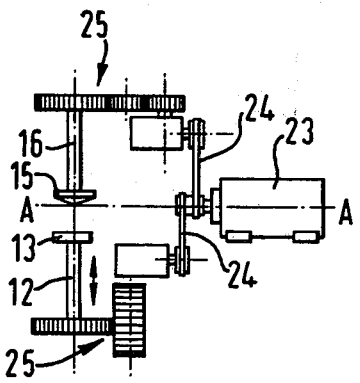
FIG. 5 is a diagram showing another arrangement of driving the platens.

The rotary drive to the spindles 12 and 16 can be as shown in FIG. 4 in which a motor 20 located on axis A—A drives the spindles 12, 16 of the platens 13 and 15 through shafts 21 and gears 22 or as shown in FIG. 5 in which a motor 23 located on axis A—A drives the spindles 12, 16 of the platens 13, 15 through belt or chain drives 24 and gears 25.

By rotating the upper and lower platens 13, 15 together with the workpiece 14 and the application of a force F of adequate magnitude, a plastically deforming region in the workpiece 14 is made to rotate about the axis $Z_1$.

Minimized errors in the workpiece 14 will result from relative displacement of the axes $Z_1$ and $Z_2$ due to the difference in radial compliance of the bearing systems being applicable when radial forces exist between workpiece 14 and upper platen 15.

By having a rotational drive system which is coaxial with the trunnion bearing axis A—A enables an uninterrupted drive by planetary motion about the trunnion bearing axis A—A and rotational drive axis.

Independent drives can be used but would require velocity locks.

In the rotary forging process the workpiece is plastically deformed to the shape determined by the geometry of the upper and lower platens.

The shape of the lower platen tool is usually such that after "forming" the workpiece requires the application of a force to remove it from the lower platen tool. Hence the tools are designed such that an area of the base is arranged to be removable thus providing a facility for ejecting the workpiece.

The kinematic arrangement of a rotary forging machine with a workpiece ejection mechanism is illustrated in FIGS. 8 to 11. The upper conical platen 31 rotates about the axis $Z_2$ and relative to the main frame 32. The lower platen 33, rotates about the axis $Z_1$ and relative to the lower platen bearing housing assembly 34 which is moved axially along the axis $Z_1$ and relative to the main frame 32, by the application of a force $F_1$ applied by piston and cylinder device 35. The lower platen bearing housing 34 is constrained from rotation about the axis $Z_1$ but can move axially relative to the main frame 32.

The workpiece 36 is located in the workpiece holder in the lower platen 33. The base portion 37 of the workpiece holder is a separate item and can be moved axially relative to the workpiece holder along the axis $Z_1$ towards the upper platen 31. This is achieved by axial displacement of an ejection mandrel 38, when moved along the axis $Z_1$ relative to the lower platen 33 and the lower platen bearing housing 34. The relative axial displacement of the ejection mandrel 38 relative to the lower platen 33 is caused by a thrust member 39 which moves axially with assembly 34 except when constrained in the downward direction movement by the position of interrupters 40. Thus the thrust member 39 applies an axial force to the ejection mandrel 38 causing the workpiece 36 to be ejected from the work holder.

Figure 8:
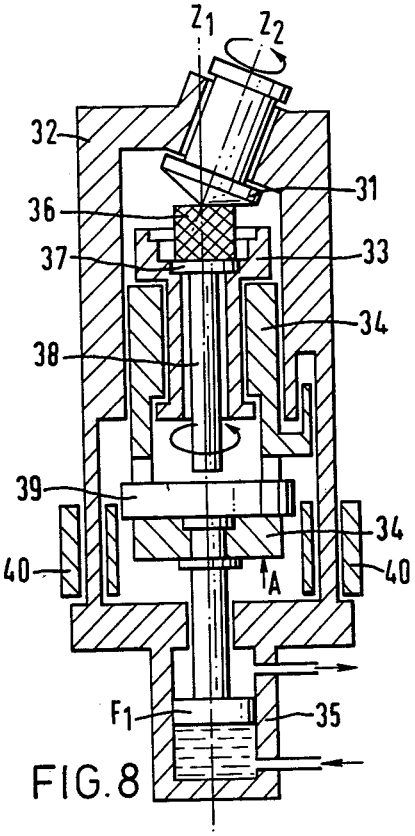
FIG. 8 is a diagram showing a rotary forging machine according to
the present invention provided with ejection means for ejecting a workpiece.

The complete operation of the workpiece ejection mechanism is described in further detail as follows:

FIG. 8 illustrates the rotary forging machine with the workpiece 36 in the loaded position and just contacting the upper platen 31 at the commencement of forging.

Figure 9:
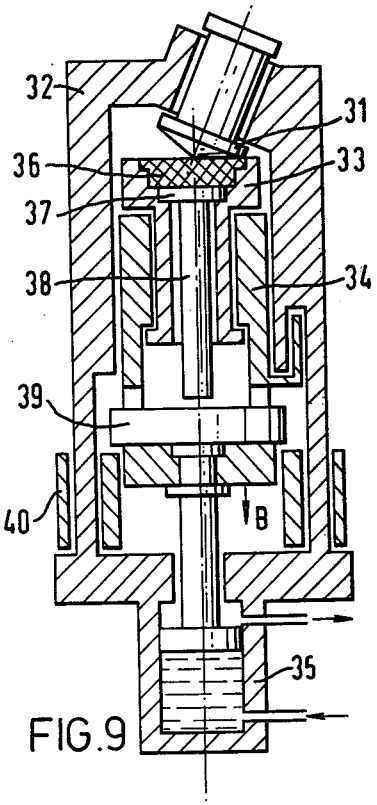
FIGS. 9 to 11 are diagrams similar to that of FIG. 8 showing the positions of the various parts during a forging cycle.

By rotation of the upper and lower platens 31 and 33 together with the application of an axial upward force $F_1$ the forging process proceeds until the workpiece 36 is deformed to the desired shape. The forging process then ceases by removal of the force $F_1$ as illustrated in FIG. 9.

Figure 10:
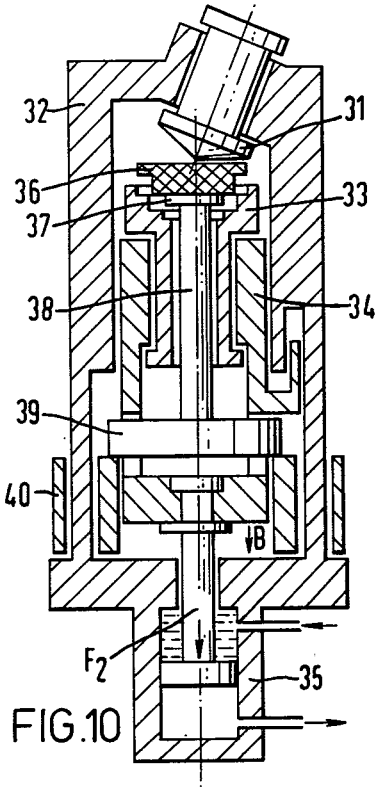
Figure 11:
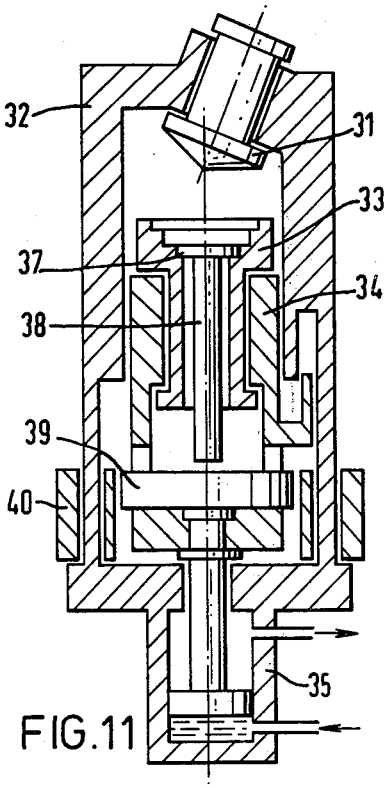

Whilst retained in this position, or at any position in which the thrust member 39 is clear of the interrupters 40, the interrupters 40 are positioned such that when the lower platen bearing housing assembly 34 moves downwardly in the direction of the arrow B, the thrust member 39 will then be restricted in displacement relative to the main frame 32. The thrust member 39, which normally rests upon the lower part of the bearing housing assembly 34, is also free to move in an upward direction relative to assembly 34. The ejection mandrel 38 will thus be restricted in displacement relative to the main frame 32. As displacement of the lower platen bearing assembly 34 continues in the direction of arrow B the ejection mandrel 38 will move axially relative to the lower platen 33 and thus eject the workpiece 36 from the workpiece holder as illustrated in FIG. 10. The force $F_2$ required to carry out this operation is applied to the assembly 34 in the direction of the arrow B.

At this stage the interrupters 40 can be repositioned out of contact with the thrust member 39 thus permitting the thrust member 39 to return to the position resting on the lower platen bearing assembly 34, the ejection mandrel 38 will descend and the workpiece holder base 37 will return to its position in the workpiece holder in readiness for the loading of a further workpiece. The machine is illustrated in this stage in FIG. 11 and at this stage is ready to be loaded with another workpiece 36 and commence a further cycle of operation.

By use of a suitable thrust bearing between ejection mandrel 38 and thrust member 39 the ejection operation may be carried out with either the platens 31, 32 rotating or stationary.

The advantages are that the down stroke of the forging process is used for ejection thus simplifying the machine construction. There is also a saving of time in the operating cycle since a separate ejection operation is obviated.

Figure 3:
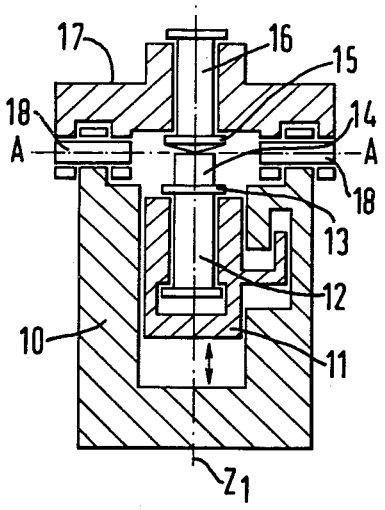
FIG. 3 is a section taken along the line 3—3 of FIG. 2.
Figure 2:
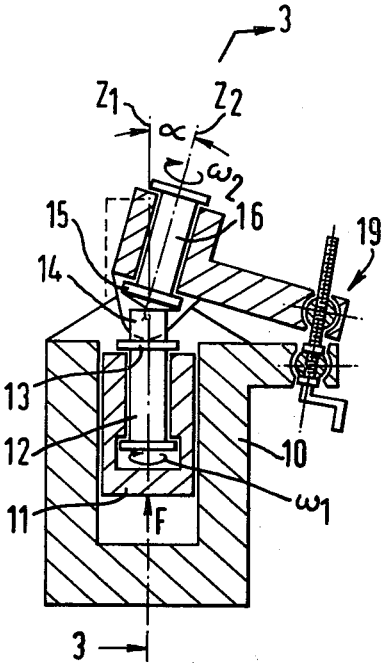
FIG. 2 is a diagrammatic longitudinal section of the rotary forging machine.

It will be appreciated that the upper platen 31 can be mounted in the same manner as platen 15 of FIGS. 2 and 3 so that angle $\alpha$ can be adjusted during operation of the machine.

The interrupters 40 may be moved by mechanically operated means or by electrical or fluid operated means.

The upper platens 10, 15 and 31 have been described and illustrated as being conical but other forms or shapes can be used as form tools.

We, therefore particularly point out and distinctly claim as our invention:

1. A rotary forging or upsetting machine comprising:
- a machine frame for operatively positioning a plurality of machine elements;
- a first platen and a second platen operatively disposed at an angle relative to each other within said machine frame;
- means for operatively rotating both platens about independent intersecting axes relative to each other and said machine frame;
- adjustment means for operatively adjusting the angle between the first and second platens while said platens are rotating; and
- displacement means for applying a force to at least one platen to operatively move it towards the other platen.

2. A rotary forging or upsetting machine according to claim 1, wherein the platens are each operatively rotated by drive transmissions driven by a common motor.

3. A rotary forging or upsetting machine according to claim 1, wherein one of the platens is rotated by frictional forces between the platen and a workpiece and the other platen is operatively rotated by a drive transmission driven by a motor.

4. A rotary forging or upsetting machine according to claim 1, wherein the adjustment means for operatively adjusting the angle between the platens is manually operated.

5. A rotary forging or upsetting machine according to claim 1, wherein the adjustment means for operatively adjusting the angle between the platens is automatically operated and means are provided for operatively varying the amplitude and frequency of adjustment of the angle in synchronization with the angular rotation of the platens and a workpiece.

6. A rotary forging or upsetting machine according to claim 1, and further including ejecting means for ejecting a workpiece from one of the platens.

7. A rotary forging or upsetting machine according to claim 6, wherein one platen is rotatably mounted in a carrier member which is axially movable relative to the machine frame by a piston and cylinder device but constrained from rotation relative to the machine frame, said one platen being provided with a workpiece holder movable axially of said one platen, said holder being displaced by an ejector member which, when the forging process is completed, is acted upon by a thrust member as the carrier member and said one platen are moved away from the other platen to move the holder relative to said one platen to remove the workpiece from said one platen.

8. A rotary forging or upsetting machine according to claim 6, wherein one platen is rotatably mounted in a carrier member which is axially movable relative to the machine frame by a piston and cylinder device but constrained from rotation relative to the machine frame, said one platen being provided with a workpiece holder movable axially of said one platen, said holder being displaced by an ejector member which, when the forging process is completed, is acted upon by a thurst member as the carrier member and said one platen are moved away from the other platen to move the holder relative to said one platen to remove the workpiece from said one platen and interrupter members are provided on the machine frame and movable between an inoperative position in which said interrupter members are clear of the thrust member and an operative position in which said interrupter members extend into the path of the thrust member when the carrier member is moved away from the said other platen.

9. A rotary forging or upsetting machine according to claim 8, wherein the interrupters are operatively movable by mechanically operated means.

10. A rotary forging or upsetting machine according to claim 1, wherein the angle between the platens is adjusted by moving one platen about an axis which passes through the point of intersection of said intersecting axes and is perpendicular to the plane in which the intersecting axes lie.

11. A rotary forging or upsetting machine according to claim 1, wherein drive transmission means are provided for rotating both platens, the rotational axis of the drive motor of the drive transmission being coincident with said axis which passes through the point of intersection of said intersecting axes.

12. A rotary forging or upsetting machine according to claim 1, wherein both of the platens have a conical surface which faces the other platen.

13. A rotary forging or upsetting machine according to claim 8, wherein the interrupters are operatively movable by electrically operated means.

14. A rotary forging or upsetting machine according to claim 8, wherein the interrupters are operatively movable by fluid operated means.

15. A rotary forging or upsetting machine according to claim 1, wherein both of the platens have a frustoconical surface which faces the other platen.

* * * * *